US007111803B2

(12) United States Patent
Mott et al.

(10) Patent No.: US 7,111,803 B2
(45) Date of Patent: Sep. 26, 2006

(54) CABLE WINCH SYSTEM

(75) Inventors: Ned E. Mott, Tarpon Springs, FL (US); John Russell, Tarpon Springs, FL (US)

(73) Assignee: Pelican Point Seafood, Inc., Tarpon Springs, FL (US)

( * ) Notice: Subject to any disclaimer, the term of this patent is extended or adjusted under 35 U.S.C. 154(b) by 118 days.

(21) Appl. No.: 10/826,581

(22) Filed: Apr. 16, 2004

(65) Prior Publication Data

US 2005/0230671 A1 Oct. 20, 2005

(51) Int. Cl.
*B65H 57/16* (2006.01)
*B65H 57/28* (2006.01)

(52) U.S. Cl. ..... 242/397.4; 254/335

(58) Field of Classification Search ..... 242/397, 242/397.1, 397.2, 397.3, 397.4; 254/385, 254/266, 335, 336
See application file for complete search history.

(56) References Cited

U.S. PATENT DOCUMENTS

| | | | | | |
|---|---|---|---|---|---|
| 830,239 | A | * | 9/1906 | Lingenfelter | 242/391.3 |
| 969,598 | A | * | 9/1910 | Buttles | 242/389 |
| 1,131,103 | A | * | 3/1915 | Arduser | 242/390 |
| 2,090,445 | A | * | 8/1937 | Hale et al. | 242/397.4 |
| 2,352,781 | A | | 7/1944 | Fletcher et al. | |
| 2,605,976 | A | * | 8/1952 | Henggeler | 242/390.7 |
| 2,822,993 | A | | 2/1958 | Swanson | |
| 3,107,877 | A | * | 10/1963 | Weaklend | 242/390.7 |
| 3,707,799 | A | | 1/1973 | Hatley | |
| 3,892,386 | A | | 7/1975 | Hogan | |
| 4,204,354 | A | | 5/1980 | Kane | |
| 5,029,762 | A | | 7/1991 | Behrens et al. | |
| 5,385,314 | A | * | 1/1995 | Hughes | 242/397.3 |
| 5,474,278 | A | * | 12/1995 | Cleveland | 254/334 |
| 5,526,995 | A | | 6/1996 | Westrich et al. | |
| 5,908,170 | A | | 6/1999 | Kunz | |
| 5,927,693 | A | | 7/1999 | Hackl | |
| 5,967,446 | A | | 10/1999 | Kudrus | |
| 5,967,496 | A | | 10/1999 | Ulrich et al. | |
| 6,109,558 | A | | 8/2000 | Mayer | |
| 6,311,919 | B1 | | 11/2001 | Hermanns et al. | |
| 6,592,066 | B1 | | 7/2003 | Hermanns et al. | |
| 2002/0117654 | A1 | | 8/2002 | Bartal | |

FOREIGN PATENT DOCUMENTS

| | | |
|---|---|---|
| JP | 11-29294 | 2/1999 |
| WO | WO 86/05166 | 9/1986 |

* cited by examiner

*Primary Examiner*—Kathy Matecki
*Assistant Examiner*—William E. Dondero
(74) *Attorney, Agent, or Firm*—Dennis G. LaPointe

(57) ABSTRACT

A cable winch system comprising a driven drum for winding and unwinding cables, a cable guide including two parallel members spaced-apart to allow for the cable to freely travel in between the members. The cable guide is pivotally attached to a geared oscillation device which cyclically guides the cable to facilitate evenly distributed winding and unwinding of the cable along one end of the drum to an opposite end of the drum. The system is operated remotely, away from the travel of the cable in a non-interfering relationship with the oscillation of the cable guide. The system can be operated hydraulically or pneumatically. A shaft with a handle on one end and the opposite end connected to a universal joint which in turn is connected to the geared oscillation device allows for the remote operation of the system.

5 Claims, 3 Drawing Sheets

CABLE WINCH SYSTEM

FIELD OF THE INVENTION

The invention relates to apparatus used on fishing boats, such as shrimp boats, by which nets are lowered and raised from the water, as well as to apparatus where operation of a winch is done in such a way that the operator's limb may be in line with the travel of the cable being wound on the winch.

BACKGROUND OF THE INVENTION

Many fishing vessels, such as shrimp boats, use nets lowered and raised from the water. The nets are extended for insertion in the water and retrieval from the water using a combination of chains, cables, trawl doors, outriggers, etc, where the cables are wound on a winch drum. Although single cables can be used from the winch to the trawl doors, generally a main cable (typically about ¾ inch in diameter) is used as the core cable and to an end of this cable, 2 or more smaller cables (e.g., three ⅝ inch diameter cables) are typically spliced. These smaller cables are attached to the trawl door, which is used as a spreader for the nets that are lowered into the water and dragged behind the boat.

One of the problems in raising the nets is ensuring that the cables are wound evenly, that is, evenly distributed, across the drum. The single larger cable is wound on the drum and the multiple cable end is then wound. If the cables are not evenly wound, then the trawl doors will not be raised simultaneously. For example, one trawl door may be lifted and the other may still be in the water.

Prior art apparatus requires that the cables be manipulated manually through guides extending from the ceiling bulkhead structure or extending from the deck area. The guides are pivotally mounted. In the situation where the guides are located so as to extend from the deck, the operator has to lean above the cables being wound on the drum. In the situation where the guides are attached to the ceiling bulkhead structure, the operator finds himself below the cables being wound on the drum. In either case, the operator is exposed to dangerous life threatening conditions.

If cable guides are located so as to extend from the deck area in front of the drum, the guide has to be manipulated by hand such that the operator has to use a lot of physical force to push the guide away from him, thereby leaning over the cables being wound or unwound. The guide then has to be pulled back toward himself to continue winding the cable in the other direction. This cycle is repeated. Meanwhile, the operator in essentially standing in the area in front of the drum in harms way of the cable lines. If cable guides are located so as to extend from the ceiling bulkhead area, the guide has to be similarly manipulated, except now the operator finds himself essentially below the cables being wound or unwound and still in front of the drum.

There is also a significant amount of tension in the cables. The trawl doors alone can weigh 2000 to 3000 pounds, and the drag force of the nets filled with shrimp also add a significant tension force to the cables being wound.

It is not uncommon for the cables to be entwined in buoys and crab lines. When these lines get near the drum, the flapping of the lines or lines that break and snap can backlash against the operator severely injuring or killing the operator. Another common problem is the unsteady seas. The winch operator is trying to maintain his balance while using force to manipulate the guides as the cable is being wound and unwound. This unsteady balance can cause the winch operator to fall into the drum or cable lines. A shrimp boat winch operator recently was killed in the Gulf of Mexico when his arm got entangled in the cables being wound. Because he was in front of the drum near the cables being wound, he could not reach the drum drive clutch to disengage the rotating drum, and was pulled into the drum reel. One can imagine after that what happened to him after being pulled into a drum reel adjacent another drum reel winding cables on the other side of the boat. According to newspaper reports, it took nearly four hours for the Coast Guard to remove the body from the wound drum.

What is needed is a system where the cables can be guided and evenly distributed on the drum while ensuring the safety of the winch operator. It is also understood that the present invention described below can apply to any winch system that has to wind a single cable, or a combination of a cable connected in line to other spliced cables, to a chain, rope, or similar lanyards and rigging lines, where the operator is at significant risk of injury or death.

SUMMARY OF THE INVENTION

The present invention is a cable winch system, which includes a drum assembly that serves as means for winding and unwinding one or a combination of cables. Although single cables can be used from the winch or drum assembly, a main cable (for example, a ¾ inch in diameter cable) may be used as the core cable and to an end of this cable, two or more smaller cables (e.g., three ⅝ inch diameter cables) may be spliced. Hereinafter, the reference to a singular cable also is intended to refer to multiple cables being wound simultaneously on the winch.

Included in the system are means for rotating the drum assembly for winding and unwinding the cable. The drum assembly can be driven electrically, pneumatically, hydraulically, or with drive systems using a combination of such technology. There are several known ways in the art to drive a winch or drum assembly.

A cable guide has two parallel elongate members wherein the elongate members are spaced-apart to allow for the cable to freely travel in between the elongate members and for guiding the winding and unwinding of the cable on the winch. The cable guide is pivotally attached to means for oscillating the cable guide so as to cyclically guide the cable for evenly distributed winding and unwinding of the cable along one end of the drum assembly to an opposite end of the drum assembly.

Also included is a remote oscillation operating means, which is in mechanical communication with the means for oscillating the cable guide. The remote oscillation operating means is located on a side of the one of the ends of the drum assembly in a non-interfering relationship with the oscillation of the cable guide.

The means for oscillating the cable guide can be a hydraulic assist or a pneumatic assist power circuit. For example, a motor and hydraulic pump can be mechanically connected to a device such as a power steering unit. The bottom end of the cable guide can be welded to a Pitman arm of a power steering unit (for example, a Ross HFB 52 hydraulic power steering unit).

The remote oscillation operating means includes a shaft in mechanical communication on one end of the shaft with the means for oscillating the cable guide. In a preferred embodiment, the shaft is aligned in a generally parallel relationship to an axis of rotation of the drum assembly. The important criteria is that the shaft and handle means at the end of the shaft for operating the oscillation of the cable guide be located and oriented in a non-interfering relationship with the winding of the cables on the drum and that the handle means be physically located outside the envelope of the cable run. Preferably a steering type of circular shaped wheel can serve as the handle means but other shapes are also acceptable as long as the handle can facilitate the rotation of the shaft, which is in turn typically connected to a universal joint. The universal joint fitting is in mechanical communication with the means for oscillating the cable guide. By turning the handle, the rollers or elongate members of the cable guide oscillates in an arc motion and guides the cable back and forth across the width of the winch drum.

To prevent the cable(s) from exiting the space between the length of the spaced-apart elongate members, the cable guide further comprises a removable cable travel securement means located at an opposite end of the cable guide pivot attachment to the means for oscillating the cable guide. In simplest form, the ends of the elongate members may have a stud type of fastener and a cross-member with apertures through which the stud fasteners can be inserted for fastening the cross-member with nuts to the elongate members.

In a preferred embodiment, the cable guide parallel elongate members each comprise an inner elongate member and an outer concentric freely rotatable elongate member or roller. The outer freely rotatable elongate member is preferably made from materials selected from the group consisting of polymer composites, metals and combinations thereof.

DETAILED DESCRIPTION OF THE INVENTION

Figure 1:
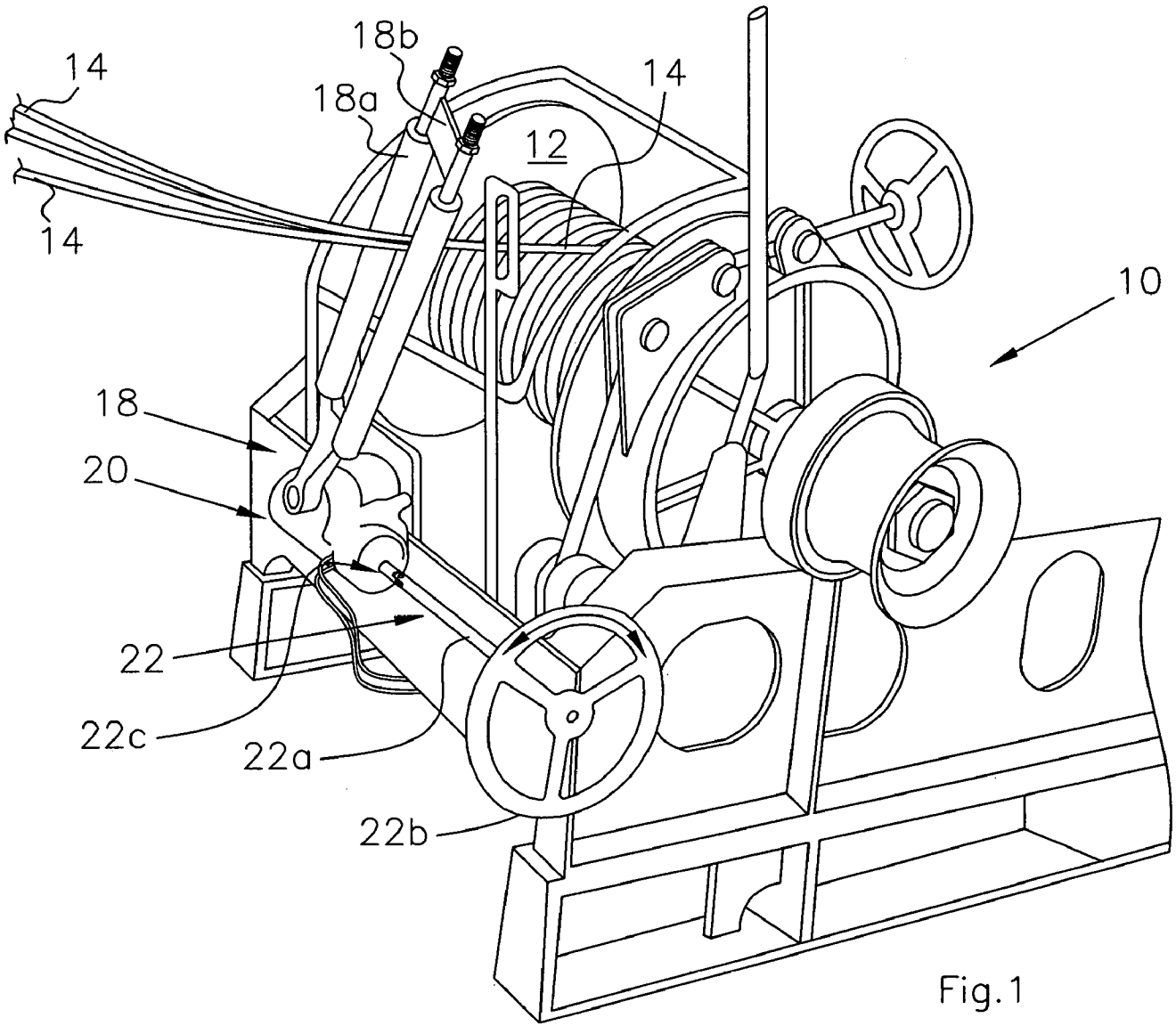
FIG. 1 is a representative conceptual perspective view of the present invention.
Figure 2:
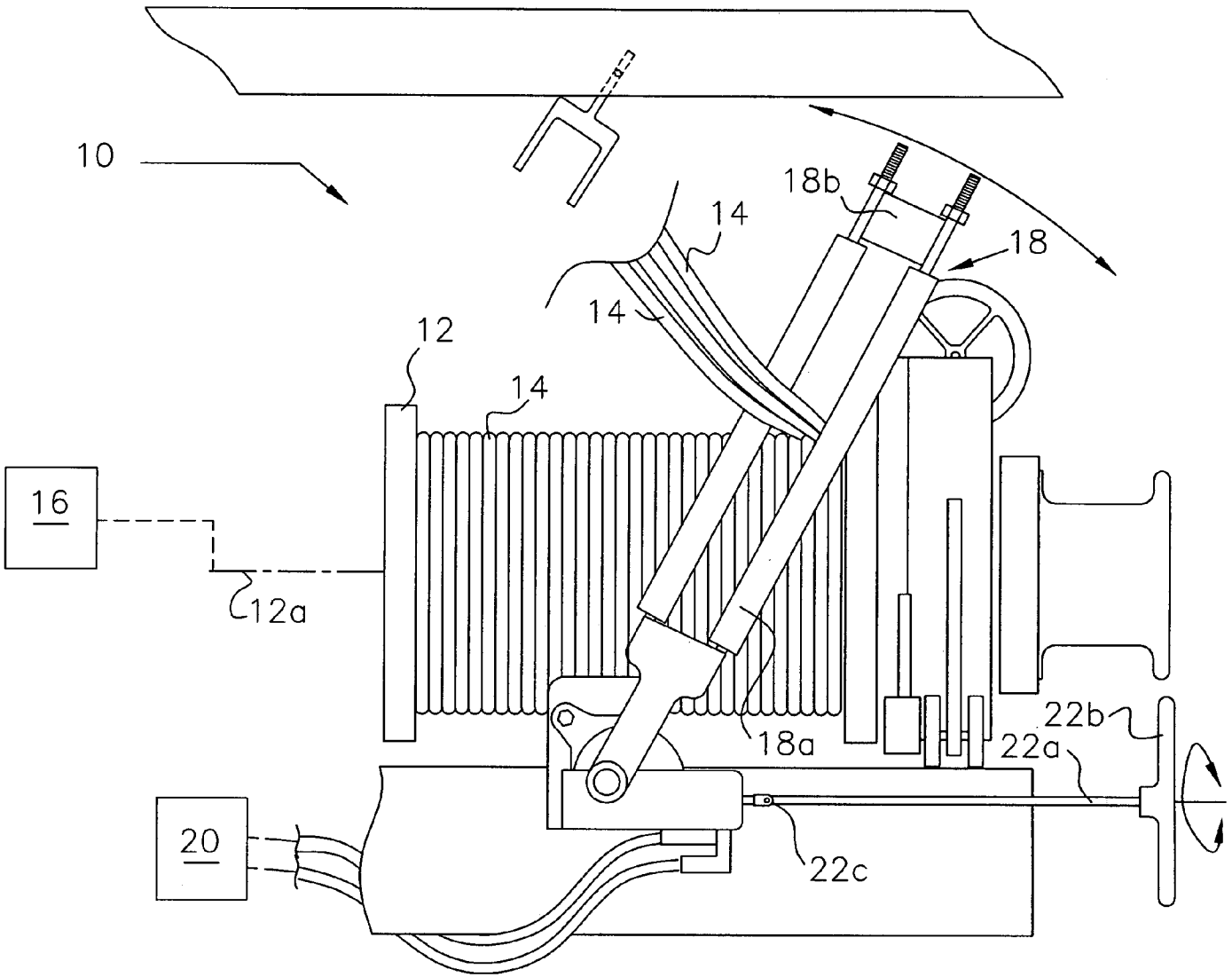
FIG. 2 is a representative conceptual depiction of a side view of the depiction of FIG. 1.

Referring now to the drawings, FIGS. 1 and 2 disclose the present invention, which is a cable winch system, depicted generally as 10. The cable winch system 10 includes a drum assembly 12, which serves as means for winding and unwinding at least one cable 14. Although single cables 14 can be used from the winch or drum assembly 12, a main cable (for example, a ¾ inch in diameter cable) may be used as the core cable and to an end of this cable, 2 or more smaller cables (e.g., three ⅝ inch diameter cables) may be spliced.

Included in the system are means 16 for rotating the drum assembly 12 for winding and unwinding the cable 14. The drum assembly 12 can be driven electrically, pneumatically, hydraulically, or with drive systems using a combination of such technology. Specific structure depicting the means 16 is not shown in the drawings, as there are several known ways in the art to drive a winch or drum assembly 12.

A cable guide 18 has two parallel elongate members 18*a* wherein the elongate members 18*a* are spaced-apart to allow for the least one cable 14 to freely travel in between the elongate members 18*a* and for guiding the winding and unwinding of the cable 14 on the winch 12. The cable guide 18 is pivotally attached to means 20 for oscillating the cable guide 18 so as to cyclically guide the cable 14 for evenly distributed winding and unwinding of the cable 14 along one end of the drum assembly 12 to an opposite end of the drum assembly 12.

Also included is a remote oscillation operating means 22, which is in mechanical communication with the means 20 for oscillating the cable guide 18. The remote oscillation operating means 22 is located on a side of the drum assembly 12 in a non-interfering relationship with the oscillation of the cable guide 18.

The means 20 for oscillating the cable guide 18 may typically be powered or driven pneumatically or hydraulically power assist components. Specific structure depicting the means 20 is not shown in the drawings, as there are several known ways in the art to drive the oscillation of the cable guide 18. For example, a motor and hydraulic pump can be mechanically connected to a device such as a power steering unit. The bottom end of the cable guide 18 can be welded to a Pitman arm of a power steering unit (for example, a Ross HFB 52 hydraulic power steering unit).

The remote oscillation operating means 22 includes a shaft 22*a* in mechanical communication on one end of the shaft 22 with the means 20 for oscillating the cable guide 18. In a preferred embodiment, the shaft 22*a* is aligned in a generally parallel relationship to an axis 12*a* of rotation of the drum assembly 12. As mentioned above, the important criteria is that the shaft 22 and handle means 22*b* attached on an end of the shaft 22*a* for operating the oscillation of the cable guide 18 be located and oriented in a non-interfering relationship with the winding of the cables 14 on the drum 12 and that the handle means 22*b* be physically located outside the envelope of the cable run. Preferably a steering type of circular shaped wheel can serve as the handle means but other shapes are also acceptable as long as the handle can facilitate the rotation of the shaft 22*a*, which is in turn typically connected to a universal joint 22*c*. The universal joint fitting 22*c* is in mechanical communication with the means 20 for oscillating the cable guide 18. By turning the handle 22*b*, the rollers or elongate members 18*a* of the cable guide 18 oscillates in an arc motion and guides the cable 14 back and forth across the winch drum 12.

To prevent the cable(s) 14 from exiting the space between the length of the spaced-apart elongate members 18*a*, the cable guide 18 further comprises a removable cable travel securement means 18*b* located at an opposite end of the cable guide pivot attachment to the means 20 for oscillating the cable guide 18. In simplest form, the ends of the elongate members 18*a* may have a stud type of fastener and a cross-member with apertures through which the stud fasteners can be inserted for fastening the cross-member with nuts to the elongate members 18*a*. In this case, the cable guide 18 may be made from steel materials or non-corrosive bronze, brass or stainless steel materials, or combinations of such materials.

Figure 3:
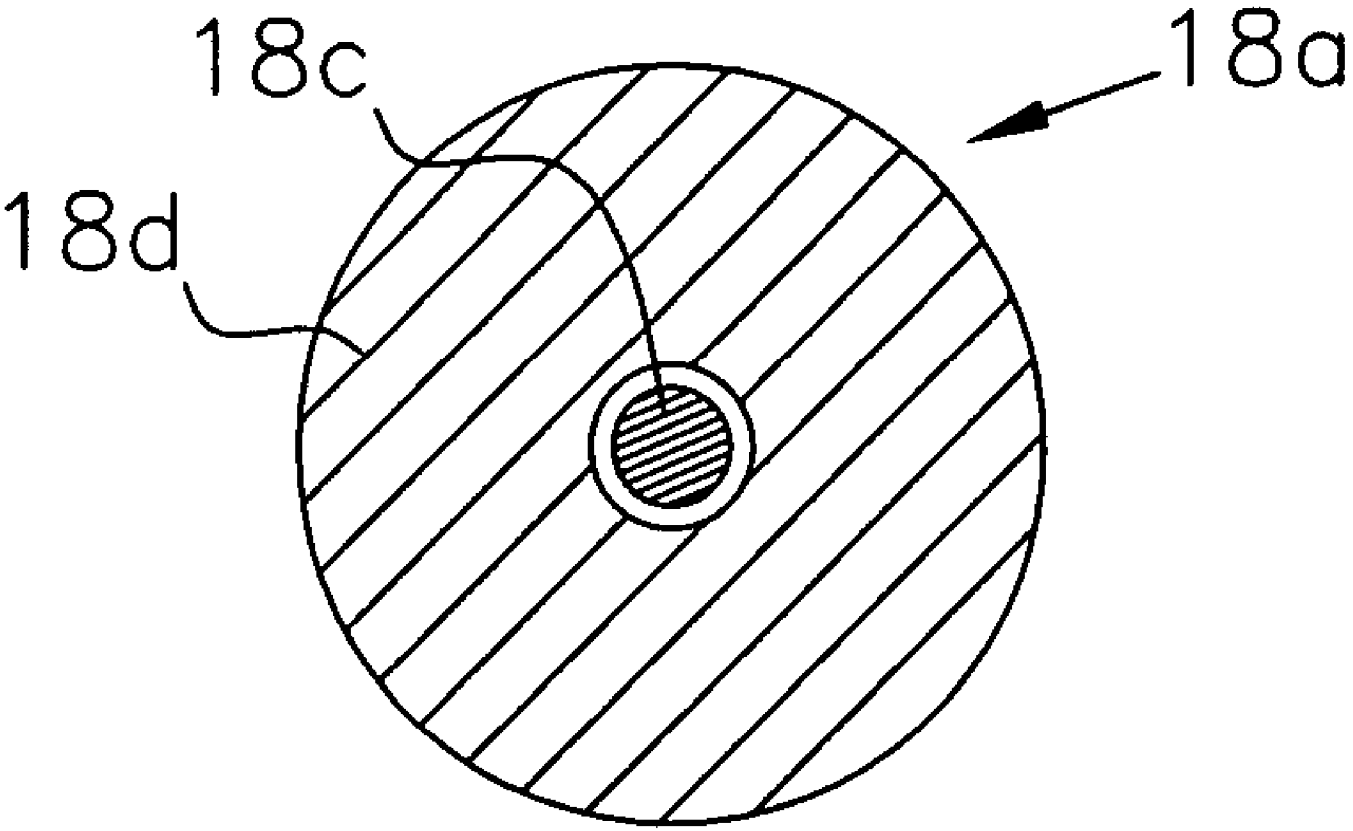
FIG. 3 is a cross-section view of one alternative embodiment of an elongate member portion of the cable guide.

In a preferred embodiment as depicted in the cross-sectional depiction of FIG. 3, the cable guide parallel elongate members 18*a* each comprise an inner elongate member 18*c* and an outer concentric freely rotatable elongate member or roller 18*d*. The outer freely rotatable elongate member 18*d* is preferably made from materials selected from the group consisting of polymer composites, metals and combinations thereof. For example, the rollers 18*d* may be made from nylon materials or TEFLON® materials.

It is understood that cables used on winch and pulley system come in a variety of materials, which are anticipated to be used with the present invention. Among those materials contemplated are fiber ropes such as marine grade rope, nylon braided ropes, cotton fiber braided rope and similar ropes; strand wire rope which is typically used in industrial grade rigging lanyards (steel or stainless steel wire rope); chains of various configurations; and any combination of rope, wire rope and chains. When wire rope is used, generally this kind of lanyard is preferably coated with a polymeric cover to help prevent chaffing as the cable is run through pulleys or on the drum itself. Similarly, chains may preferably be coated. Cable 14 is shown generically in the drawings but is representative of any of the combinations discussed. It is also understood that the load and use is not limited to fishing boats but can apply to any use where cable under high tension loads is wound on drums and needs to be wound evenly on the drums.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A fishing vessel cable winch system for lowering nets into the water and raising nets from the water comprising:

a drum, the drum being means for winding and unwinding at least one cable, said at least one cable being adapted for use on a fishing trawler and is further sized to handle a load of at least 2000 lbs in tension;

means for continuously rotating the drum for level winding and unwinding said at least one cable;

a cable guide, the cable guide including two parallel elongate members wherein the elongate members are spaced-apart to allow for the least one cable to freely travel along at least a portion of a length of said elongate members in between said elongate members and for guiding the winding and unwinding of said at least one cable on the drum;

the cable guide being pivotally attached to means for oscillating said cable guide so as to cyclically guide the at least one cable for evenly distributed winding and unwinding of the at least one cable along one end of the drum to an opposite end of the drum, said means for oscillating said cable guide comprising a power assist unit driven pneumatically or hydraulically; and remote oscillation operating means in mechanical communication with the means for oscillating said cable guide, said remote oscillation operating means being operably independent of the means for rotating the drum, said remote oscillation operating means extending to a side of the one of the ends of the drum so as to be in a non-interfering relationship with the oscillation of the cable guide, and said remote oscillation operating means further having handle means for remote manual operation of said remote oscillation operating means, said handle means being located on the outside of the one of the ends of the drum and outside an envelope of the cable oscillation movements of the cable guide, such that a winch operator manually operating the remote operating handle means can not be entrapped by the at least one cable and can not be at risk of bodily harm due to the at least one cable breaking due to a failure while in tension during operation of the remote operating handle means, wherein the remote oscillation operating means includes a shaft in mechanical communication on one end of said shaft with said means for oscillating said cable guide, said shaft being aligned in a generally parallel relationship to an axis of rotation of the drum, and said handle means being attached on an opposite end of the shaft.

2. The system according to claim 1, wherein the shaft is attached to a universal joint fitting, which in turn is in mechanical communication with the means for oscillating said cable guide.

3. The system according to claim 1, wherein the cable guide further comprises a removable cable travel securement means at an opposite end of the cable guide pivot attachment to the means for oscillating said cable guide, said removable cable travel securement means being means for preventing the at least one cable from exiting outside the space between the parallel elongate members.

4. The system according to claim 3, wherein the cable guide parallel elongate members each comprise an inner elongate member and an outer concentric freely rotatable elongate member.

5. The system according to claim 4, wherein the outer freely rotatable elongate member is made from materials selected from the group consisting of polymer composites, metals and combinations thereof.

* * * * *